US005357692A

United States Patent [19]

Murray

[11] Patent Number: 5,357,692

[45] Date of Patent: Oct. 25, 1994

[54] PORTABLE ICE WALKING ASSISTANCE DEVICE

[76] Inventor: Richard F. Murray, 18 Lincoln St., Essex Junction, Vt. 05452

[21] Appl. No.: 110,783

[22] Filed: Aug. 23, 1993

[51] Int. Cl.[5] ..... A43C 15/00

[52] U.S. Cl. ..... 36/62; 36/64

[58] Field of Search ..... 36/61, 62, 64, 65, 67 B, 36/59 R, 132, 136

[56] References Cited

U.S. PATENT DOCUMENTS

| | | | |
|---|---|---|---|
| 1,042,520 | 10/1912 | Youhas | 36/62 |
| 1,589,877 | 6/1926 | Foley | 36/64 |
| 2,107,617 | 2/1938 | Oetterer | 36/62 |
| 2,143,319 | 1/1939 | Janssen | 36/62 |
| 2,431,748 | 12/1947 | Gershak | 36/62 |
| 2,577,478 | 12/1951 | Nordin | 36/62 X |

FOREIGN PATENT DOCUMENTS

| | | | |
|---|---|---|---|
| 2039611 | 10/1992 | Canada | 36/62 |
| 2634362 | 2/1990 | France | 36/62 |
| 20315 | of 1891 | United Kingdom | 36/62 |

*Primary Examiner*—Paul T. Sewell
*Assistant Examiner*—BethAnne C. Cicconi
*Attorney, Agent, or Firm*—Thomas N. Neiman

[57] ABSTRACT

The novel portable ice walking assistance device comprises a plurality of main horizontal plates. Each of the plates have foldable vertical end pieces at one end of the main horizontal plates. The main plates are attached together to form a three sided device that can be positioned on the sole of the user's shoe. A pair of the devices is used by an individual. Each of the horizontal plates have a plurality of small vertical prongs to assist in the gripping capability in ice conditions. A quick release mechanism is connected to one of the vertical end pieces to permit attaching to the shoe and ease of release of the device.

5 Claims, 1 Drawing Sheet

PORTABLE ICE WALKING ASSISTANCE DEVICE

BACKGROUND OF THE INVENTION

This invention pertains to ice gripper devices, and, in particular, to a portable ice walking assistance device that can be kept in the pocket of the individual an used at any time assistance is necessary.

A large number of devices have been developed to assist individuals who have to walk in icy conditions. Unfortunately, most of the devices are large and bulky enough not to be able to be carried in an individuals pocket, so these devices normally wind up in the glove compartment of an automobile or in a desk draw or in the home. So, if an individual does not have access to these devices because the icing conditions occur suddenly, they are of no value. Examples of these devices are shown in the United States Patent issued to Gajewski, U.S. Ser. No. 940,799 on Nov. 23, 1909 and the United States Patent issued to Oetterer, U.S. Ser. No. 2,107,617 on Feb. 8, 1939.

What is needed is a portable ice walking assistance device which is easy to manufacture and easy to assemble and simple to use. It is the object of this invention to teach a device that can be folded simply into a compact pouch and kept in the pocket of the user.

SUMMARY OF THE INVENTION

Particularly, it is the object of this invention to set forth a portable ice walking assistance device for use by individuals in slippery conditions, comprising a plurality of horizontal plates: said horizontal plates have adjustable connection means for permitting said plates to be connected to each other; said horizontal plates further having a plurality of vertical spikes extending downward from said horizontal plates for providing traction for said device; said horizontal plates further having rotatable end portions for permitting said device to be positioned to the sole of the user's shoe; said rotatable end portions having hooking means for attaching said end portions to said to said horizontal plates; said rotatable end portions to further having protruding means for holding said rotatable end portions against said soles of said shoes; one of said rotatable end portions further having extending means for locking said device on said sole; and said extending means having release means for retracting said extending means when said device is to be removed from said shoe.

BRIEF DESCRIPTION OF THE INVENTION

Further objects and features of this invention will become more apparent by reference to the following description taken in conjunction with the accompanying figure, in which.

DESCRIPTION OF THE PREFERRED EMBODIMENTS

Figure 1:
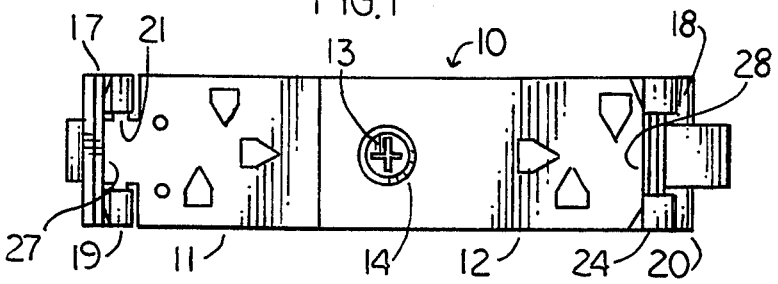
FIG. 1 is a top plan view of the novel ice walking assistance device.
Figure 3:
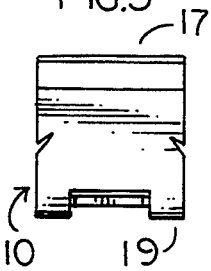
FIG. 3 is a left side elevational view thereof.
Figure 2:
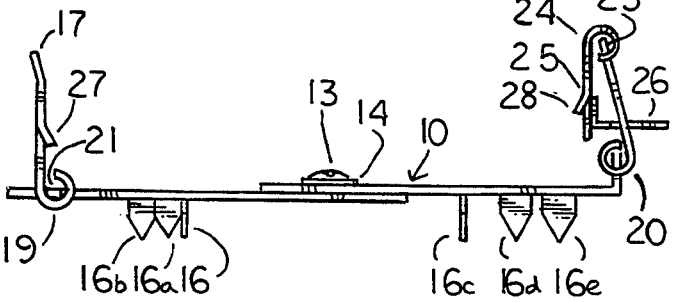
FIG. 2 is a front elevational view thereof.
Figure 4:
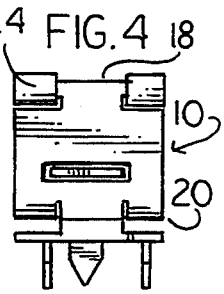
FIG. 4 is a right side elevational view thereof.
Figure 5:
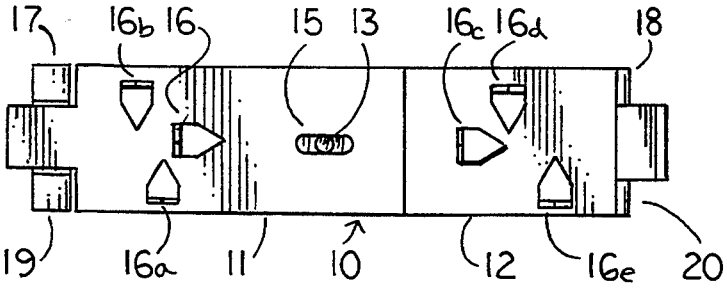
FIG. 5 is a bottom plan view thereof.
Figure 6:
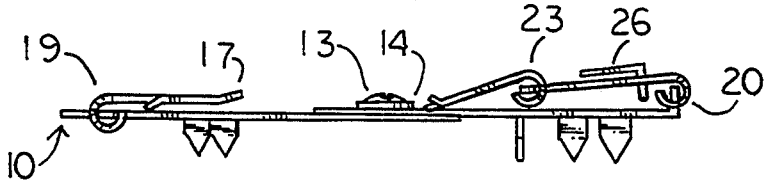
FIG. 6 is a front elevational view of the novel device in the folded position.

As shown in the figures, the novel ice walking assistance device 10 is comprised of a plurality of horizontal plates 11 and 12 which are attached together by means of a screw 13 and washer 14 that are inserted into an aperture in horizontal plate 11 and an adjustment slot 15 in horizontal plate 12. The device can be made of stainless steel or heavy duty plastic or the like. Each of the horizontal plates 11 and 12 have a plurality of vertical spikes 16 through **16*e* which extend downward from the horizontal plates 11 and 12 in order to provide the traction necessary for those using the device 10** in slippery or icy conditions.

The device 10 has rotatable end portions 17 and 18 attached to the horizontal plates by means of having looped ends 19 and 20 which extend around rod ends 21 and 22 of the horizontal plates. This design permits the end portions to be rotated flat when the unit is not in use. At the top of end portion 18 is a horizontal rod extension 23 around which a looped end 24 of a vertical plate 25 with a horizontal rod 26 extends. This assembly is designed to snap the device into place on the sole or heel of the shoe by tightening vertical plate 25 against the sole or heel and then allows the user to release the device when he or she does not need the device. Small prongs 27 and 28 are used to assist in keeping the device in place. The user would have a pair of the devices and keep them in small pouches in his or her pocket, so that they can have access to them at any time they run into icing conditions.

While I have described my invention in connection with specific embodiments thereof, it is clearly to be understood that this is done only by way of example and not as a limitation to the scope of our invention as set forth in the objects thereof and in the appended claims.

I claim:

1. A portable ice walking assisting device for use by individuals in slippery conditions, comprising:

a plurality of horizontal plates;

said horizontal plates having adjustable connection means for permitting said plates to be connected to each other;

said horizontal plates further having a plurality of vertical spikes extending downward from said horizontal plates for providing traction for said device;

said horizontal plates further having rotatable end portions for permitting said device to be positioned to the sole of the user's shoe;

said rotatable end portions having hooking means for attaching said end portions to said horizontal plates;

said hooking means allowing said rotatable end portions to lay parallel to said horizontal plate when folded for storage;

said rotatable end portions further having protruding means for holding said rotatable portions against said soles of said shoes;

one of said rotatable end portions further having extending means for locking said device on said sole; and said extending means having release means for retracting said extending means when said device is to be removed from said sole.

2. A portable ice walking assistance device, according to claim 1, wherein:

said horizontal plates comprise lightweight, sturdy material;

one of said horizontal plates having an adjustment aperture;

the other of said horizontal plates plates have an adjustment slot located therein; and said adjustable connection means comprises a screw and lock washer to be inserted in said adjustment aperture and said adjustment slot.

3. A portable ice walking assistance device, according to claim 1, wherein:

said hooking means in said end portions comprise closed loops on said end portions that are positioned around extension on said horizontal plates.

4. A portable ice walking assistance device, according to claim 1, wherein:

said protruding means comprises small, inward spikes.

5. A portable ice walking assistance device, according to claim 1, wherein:

said extending means on one of said end portions comprises a rotatable vertical plate attached to the top end of said end portion;

said extending means further comprises a horizontal control plate attached to said vertical plate for permitting the user to push the extending means to lock the unit in position and pull the horizontal control plate to release said device from said sole of the shoe.

* * * * *